United States Patent [19]

Lynott

[11] 4,106,667

[45] Aug. 15, 1978

[54] APPARATUS AND METHOD FOR CONDUCTING FINANCIAL TRANSACTIONS

[75] Inventor: John Joseph Lynott, Los Gatos, Calif.

[73] Assignee: International Business Machines Corporation, Armonk, N.Y.

[21] Appl. No.: 752,503

[22] Filed: Dec. 20, 1976

[51] Int. Cl.[2] ..... G07F 11/00

[52] U.S. Cl. ..... 221/1; 221/7; 221/97; 221/121; 221/198

[58] Field of Search ..... 221/2, 7, 97, 98, 99, 221/121, 122, 1, 198

[56] References Cited

U.S. PATENT DOCUMENTS 1,980,819 11/1934 Nelson ..... 221/197 X

*Primary Examiner*—Allen N. Knowles
*Attorney, Agent, or Firm*—Henry E. Otto, Jr.

[57] ABSTRACT

A currency dispensing apparatus employs a removable portable cartridge having a plurality of compartments for storing currency of differing denominations to be dispensed during successive transactions, another compartment for receiving a journal record printed as each transaction is completed, and a different compartment (preferably defined by a detachable portion of the cartridge) for storing rejected currency. Upon removal from the apparatus, the cartridge will thus contain all undispensed currency, including rejected currency, and also contain a complete journal record of all transactions conducted at the apparatus using that particular cartridge. The cartridge comprises two concentric members, the outer having an opening through which currency is dispensed, and the inner providing the compartments. The appropriate currency compartment is rotatably aligned with the dispensing opening, which is adjacent a dispensing station. The outer member is also rotatable independently of the inner member to change the position of the opening to enable detachment and later reinsertion of the different compartment. In a multiple dispensing station transaction terminal having three access stations 120° apart, the outer member is rotatable to the respective stations so that all may be serviced by a single cartridge.

17 Claims, 6 Drawing Figures

20a
20c
13
20b
23
(A)
10
19

11
18c
16
75a
12a
18b
17
72a
24
72b
18a
12
14b
15
14a
(B)

FIG. 4
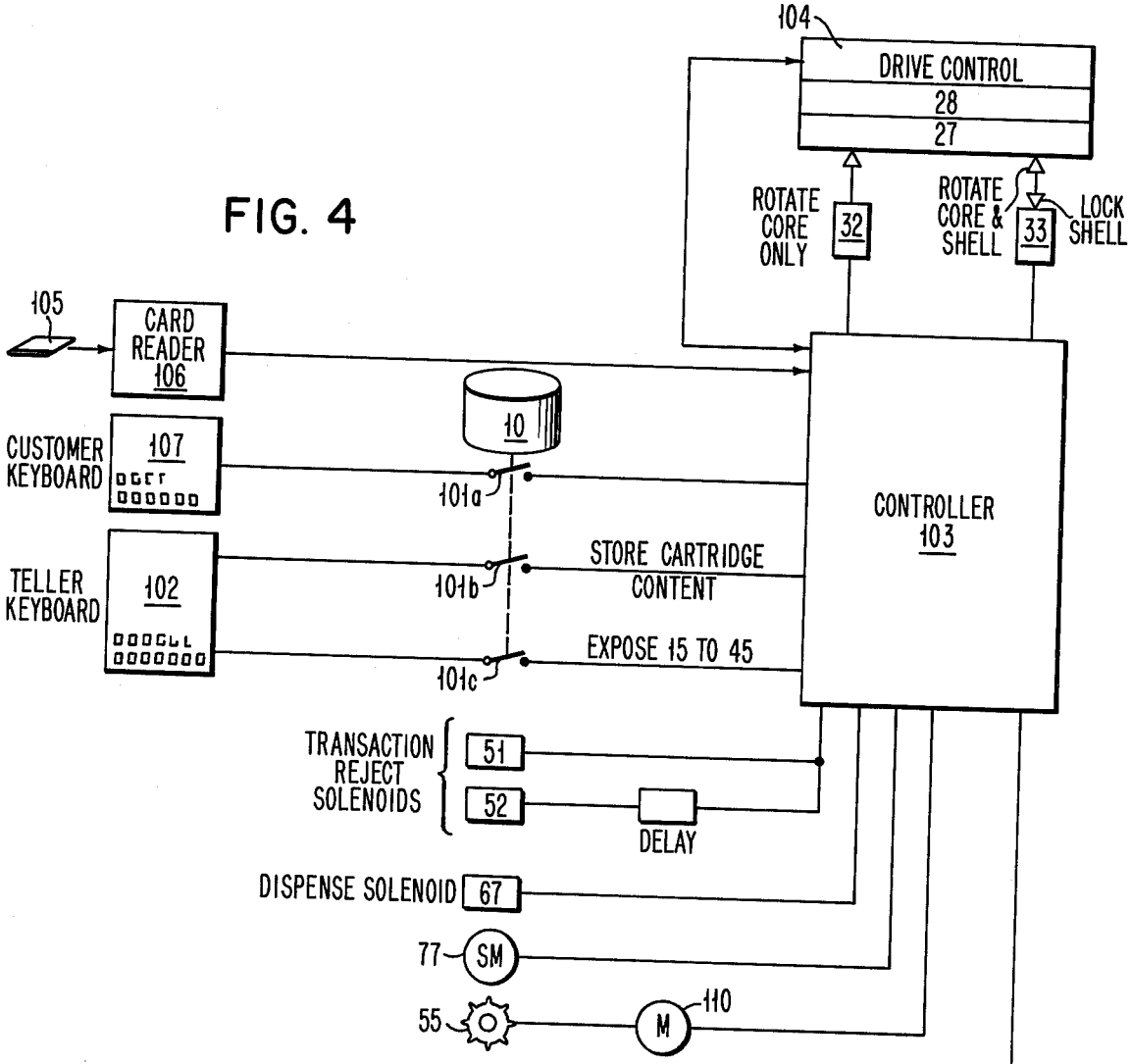
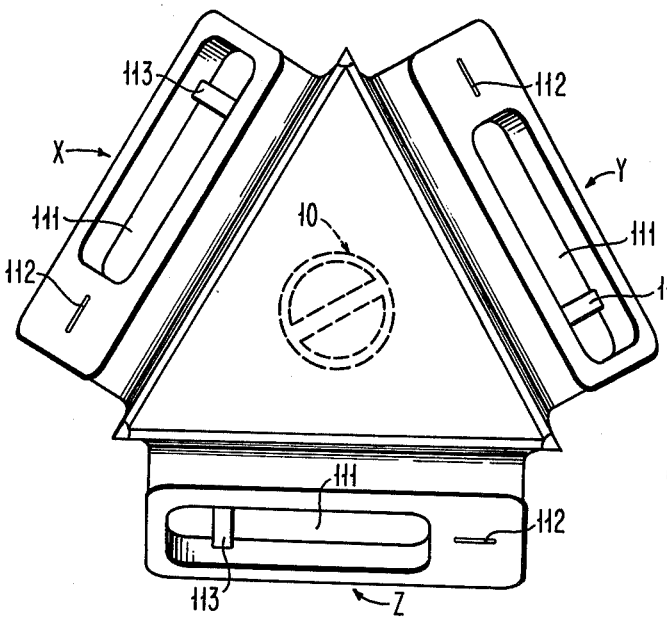
FIG. 5

APPARATUS AND METHOD FOR CONDUCTING FINANCIAL TRANSACTIONS

BACKGROUND OF THE INVENTION

This invention relates to an apparatus and method for conducting financial transactions. More particularly, it relates to an apparatus and method wherein currency containing cartridges are removably insertable in the apparatus so that upon removal from the apparatus, after completion of a series of transactions, the cartridge will contain not only all undispensed currency, including rejected currency, but also contain automatically printed journal records pertaining to all said transactions.

U.S. Pat. No. 3,899,103 discloses an automatic currency dispensing apparatus comprising a currency container having a plurality of compartments, each containing currency of different denominations and rotatable (by means not shown) selectively into alignment with a currency dispensing station. This container apparently normally remains a part of the apparatus and it is not intended to be portable and replaceable.

U.S. Pat. Nos. 2,805,675 and 3,527,238 each disclose a currency dispensing system comprising a series of rectangular removable parallel magazines each containing currency of a single preselected denomination and arranged in a rectangular side-by-side array.

U.S. Pat. No. 3,760,158 discloses side-by-side parallel stacks of currency, each of different denominations and contained in a wheeled cabinet; the specification concludes, however, with a general suggestion that as an alternative "The stacks may be housed in detachable cassettes which have been preloaded with a supply of notes."

No prior art is known which discloses or even remotely suggests a currency dispensing apparatus or the like employing a portable removable cartridge which not only has a plurality of compartments adapted to store a plurality of bills of differing denominations but also is capable of storing rejected currency and a journal record of each transaction.

SUMMARY OF THE INVENTION

The principal object of this invention is therefore to provide an improved currency dispensing apparatus wherein, upon removal of a portable currency-dispensing cartridge from the apparatus, the cartridge will contain not only undispensed currency but also a record showing transaction data relating to all transactions involving the currency dispensed from that cartridge.

Another object is to provide such an apparatus wherein the cartridge also will receive and store currency which is rejected and therefore not dispensed.

A further object is to provide an apparatus having a cartridge of the above type wherein rejected currency is stored in a compartment provided by a portion of the cartridge that is removable and positionable adjacent the currency dispensing path.

Still another object is to provide an apparatus having a plurality of currency dispensing locations arranged to be separately accessed but serviced by a single rotatable cartridge.

These and other objects, features and advantages will become apparent from the following more particular description of preferred embodiments of the invention, as illustrated in the accompanying drawings.

BRIEF DESCRIPTION OF THE DRAWINGS

FIG. 4 is a block diagram of the circuitry employed in the apparatus embodying the invention; and FIG. 5 is a schematic view of a currency dispensing apparatus constructed according to a variation of the invention and including multiple dispensing stations serviced by a single cartridge.

DETAILED DESCRIPTION OF THE INVENTION

Figure 1:
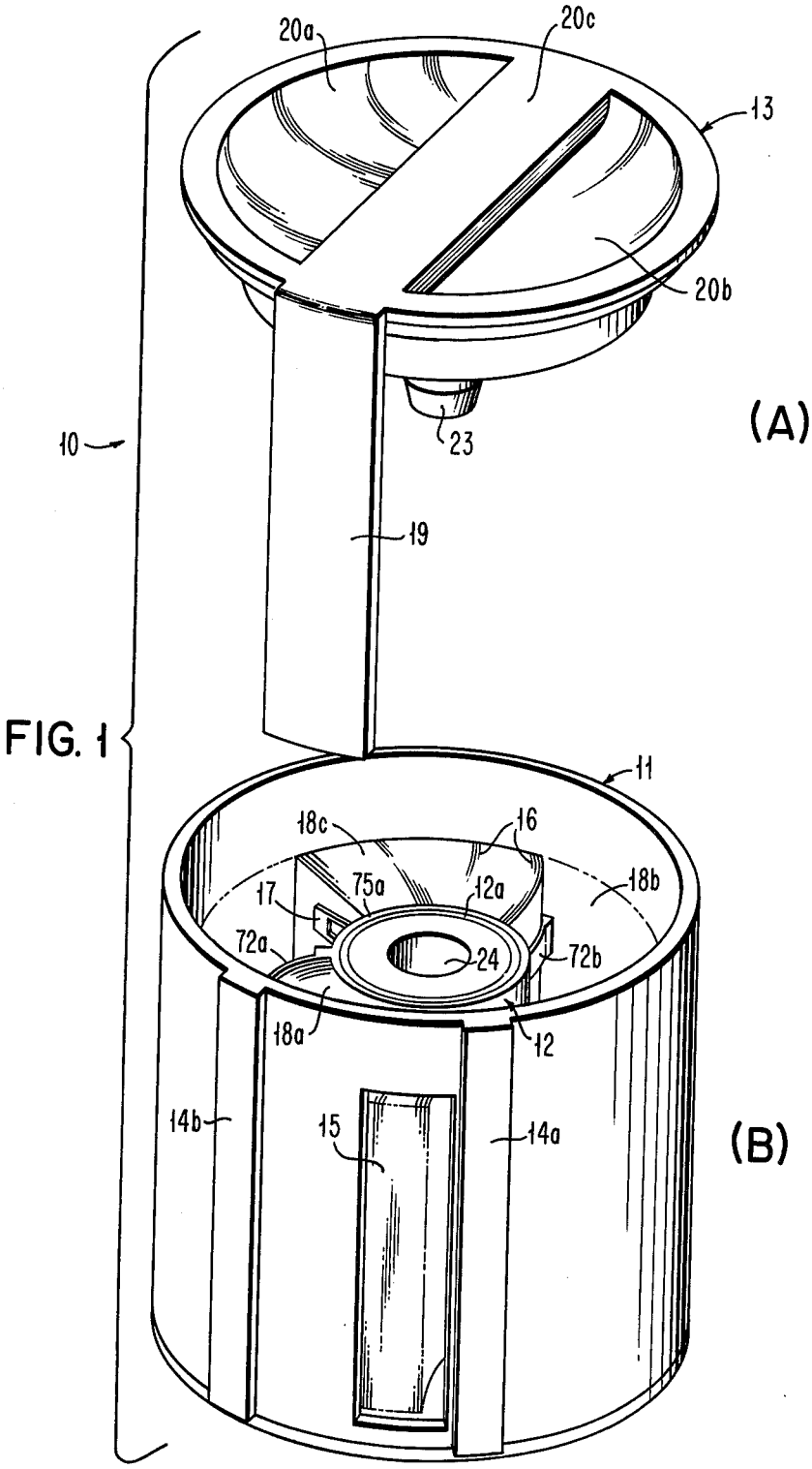
FIG. 1A, B is an exploded view of a cartridge for use in a currency dispensing apparatus embodying the invention.

As illustrated in FIG. 1A, B the apparatus embodying the invention comprises a currency dispensing cartridge 10 which includes two concentric members in the form of an annular shell 11 surrounding a core 12. The cartridge also includes a combined handle and cover 13. Projecting radially outward from shell 11 are two circumferentially spaced, integrally formed keys 14*a, b*. Between keys 14*a, b* is an elongated, vertical slot-like opening 15 through which currency 16 is adapted to be dispensed. Core 12 is divided by fixed stops 17 (see FIG. 3) into a plurality of compartments, such as 18*a, b, c*, each containing currency bills of a different denomination (e.g., $20, $5 and $1). The currency is inserted within each compartment by hand after core 12 is inserted within shell 11, as shown in FIG. 1B. Then cover 13 is installed to enclose the top of the cartridge.

Cover 13 has a depending portion 19 that is narrower than the distance between keys 14*a, b* and preferably is normally latched in a closure position, in which it overlies and covers the opening 15, to prevent removal of currency. The outer surface of cover 13 is recessed at 20*a, b* to form a handle 20*c* by which the cover can be grasped and rotated to expose opening 15.

Figure 2:
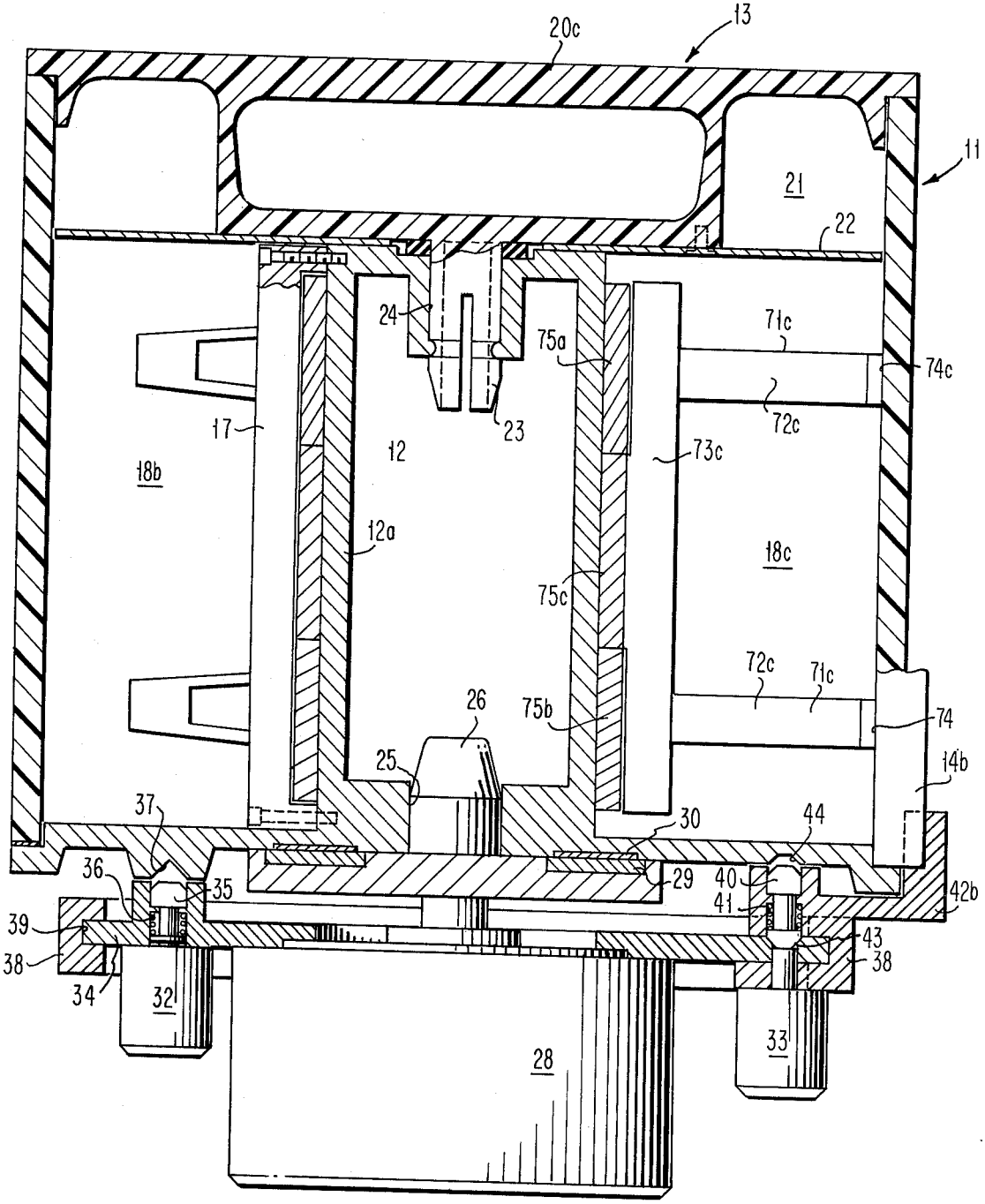
FIG. 2 is a vertical section view of the cartridge and associated drive motor.

As illustrated in FIG. 2, radially outward of the recess-defining rib there is an annular compartment 21 defined between the shell 11, top of cover 13 and a washer 22 that rests on the upper surface of core 12. Cover 13 has a coaxially arranged depending shaft portion 23 which snap fits into a bore 24 in core 12. Core 12 also has a coaxially arranged bore 25 at its lower end for receiving an aligning dowel 26 that projects coaxially from a turntable 27 rotatably driven by a motor 28. An electromagnetic clutch disk 29 cooperates with a metal washer 30 inset into the lower end of core 12 to electromagnetically couple the turntable to the core.

Outboard of turntable 27 are two solenoids 32, 33 carried on an annular grounded, generally flat support plate 34 that is rigidly connected to the housing of motor 28. Solenoid 32 has a plunger 35 normally biased by a spring 36 to a retracted position, in which it is shown in FIG. 2. With plunger 35 retracted, core 12 can be rotated by turntable 27 through clutch 29, 30 relative to shell 11 to align a selected currency compartment 18*a, b,* or *c* with dispensing opening 15; whereupon solenoid 32 is energized to cause plunger 35 to project into a notch 37 in the under surface of core 12 to lock the cartridge in the currency dispensing position thus selected.

Solenoid 33 is mounted to the underside of a ring 38 that has a circumferential groove 39 for receiving the outer edge portion of support plate 34. Ring 38 carries ball bearings (not shown) to enable it to be rotated freely relative to plate 34 as well as being supported by plate 34. Solenoid 33 has a double-ended plunger 40 that is normally biased by a spring 41 to a lower position. A pair of lugs 42*a, b* (see FIG. 3) are formed integrally with and project upwardly from ring 38 a short distance along the exterior of shell 11. These lugs straddle and confine the keys 14*a, b,* respectively, thus precisely defining the insertion position for cartridge 10.

With plunger 40 retracted, as shown in FIG. 2, it will project into a notch 43 in plate 34, for locking ring 38 and hence lugs 42*a, b* and shell 11 against rotation, while enabling core 12 to rotate relative to ring 38. When solenoid 33 is energized, plunger 40 will project into a notch 44 in the under surface of core 12 to latch ring 38 and hence lugs 42*a, b* and shell 11 to the core. Hence, by energizing solenoid 33, rotary motion of turntable 27 will be transmitted via core 12 and plunger 40 to ring 38 for causing the core, shell and cover to rotate as a unit. This type of motion is necessary to align dispensing opening 15 with an escrow portion 45 (FIG. 3) of the cartridge 10 that is removable from core 12 and normally retained within the core by shell 11.

Figure 3:
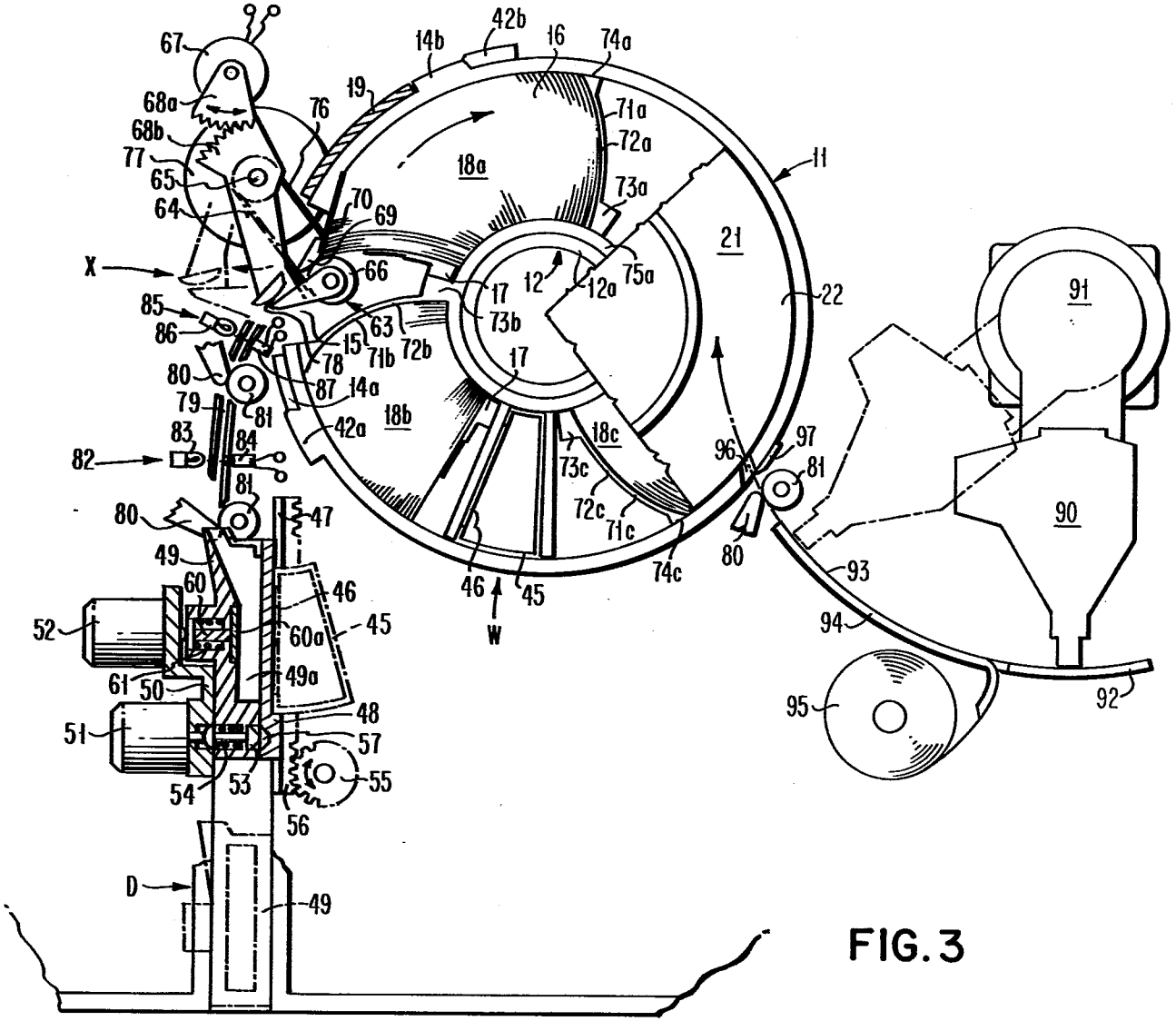
FIG. 3 is a schematic view of the apparatus embodying the invention, partly broken away.

As illustrated in FIG. 3, escrow portion 45 has an opening 46 in one of its radial sides. Portion 45 is manually removable from a ribbed sector of cartridge 10 while the shell opening 15 is aligned therewith. Portion 45 is then latched to a stationary apertured retainer plate 47, such that the escrow opening 46 is exposed to the aperture and is directly adjacent a movable slide 48. Slide 48 constitutes one side of a generally rectangular hollow shuttle member 49 normally disposed at an escrow station, as shown, and providing an enclosed space or chamber 49*a*. This shuttle chamber 49*a* forms part of the currency dispensing path. Currency of the selected denominations is accumulated in chamber 49*a* prior to movement of the shuttle to the exterior of the apparatus to dispense the currency to the customer.

At this escrow station, at the opposite side of the shuttle from the escrow cartridge portion 45, there is a stationary bracket 50 that supports two solenoids 51, 52. Solenoid 51 has a double-ended plunger 53 that is biased by a spring 54 to a retracted position, in which it is shown in FIG. 3. With the plunger retracted, slide 48 can be moved laterally relative to the remaining portion of shuttle member 49 by a pinion 55 that engages a rack 56 affixed to the lower part of the slide. When solenoid 51 is energized, however, plunger 53 is projected into a notch 57 in slide 48, thus latching the slide to the remainder of the shuttle member 49. Now, when pinion 55 is rotated, the entire shuttle member 49 will be shifted laterally to a position D indicated in phantom lines in FIG. 3 to dispense the accumulated currency to the customer. Note that the beveled left end of plunger 53 will be cammed out of bracket 50 as slide 48 starts to move.

Solenoid 52 has a plunger 60 that is biased by a spring 61 to a retracted position, in which it is shown in FIG. 3. In this position, a flat end portion 60*a* of plunger 60 is flush against the wall of chamber 49*a*. When solenoid 52 is energized, due to currency being misfed or other predetermined causes, plunger 60 will be projected to cause any currency then in chamber 49*a* to be driven by plunger portion 60*a* through opening 46 and into the escrow cartridge portion 45; this will occur, however, only after a time delay during which slide 48 has been shifted laterally relative to chamber 49*a* to expose the opening 46.

A currency feed device 63 is located at a currency dispensing station X. Device 63 comprises a lever 64 normally pivoted clockwise, as viewed in FIG. 3, about a pin 65 to maintain a feed roll 66 retracted from cartridge 10 so the latter may be rotated. After the shell and/or core of cartridge 10 are rotated to bring the proper compartment 18*a, b* or *c* into alignment with opening 15, a rotary solenoid 67 is energized. This causes meshing gear segments 68*a, b* connected to solenoid 67 and lever 64, respectively, to swing roll 66 counterclockwise into an operative position, in which it is shown in FIG. 3. In this position, feed roll 66 frictionally contacts a restraint pad 69 carried by spaced flexible fingers 70 (only one shown) that are affixed to the inner wall of shell 11. Fingers 70 help to fan out the currency 16 as it approaches the nip of roll 66 and pad 69.

Fanning is also assisted by compactors 71*a, b, c* that are freely rotatable about control annulus 12*a* of core 12 within the respective currency compartments 18*a, b, c.* These compactors comprise vertically spaced flexible fingers 72*a, b, c* (FIG. 2) supported at their inner ends by compactor lugs 73*a, b, c* (only one shown) and having friction pads 74*a, b, c* at their outer ends, which engage the inner wall of the shell 11. Each compactor 71*a, b, c* comprises a ring portion 75*a, b, c* slidably encircling core annulus 12*a,* and supporting the respective lugs 73*a, b, c,* which are nested in circumferentially spaced relation about annulus 12*a* between the fixed stops 17; i.e., lug 73*a* extends downwardly outboard of ring 75*a,* and lug 73*b* extends upwardly outboard of ring 75*b.* Thus, clockwise movement of core 12 (preferably one revolution after each transaction is completed) will automatically compact the currency with a force that is a function of the selected spring rate of fingers 72 and the frictional characteristics of the pads 74.

Currency is dispensed one bill at a time by roll 66, which is suitably rotated by a belt 76 and a clutched stepping motor 77. As each currency bill exits from a throat 78 in device 63, it enters a guide chute 79 leading to compartment 49*a* of shuttle member 49. Spaced apart approximately the width of a single dollar bill along this chute are a pair of sheet feed devices 80. These are perferably of the type covered by U.S. Pat. No. 3,747,921, assigned to the assignee of the present invention. These devices 80 cooperate with respective rubber surfaced idler rolls 81 to drive sheets, such as currency bills, with a series of jabbing, scuff-like vibratory elliptical cyclic motions. A 240 Hz driving frequency, for example, can feed currency bills at a rate of 10–15 inches per second.

Between the devices 80 is a double bill detector 82 comprising a light source 83 and a sensor 84 that is associated with conventional circuitry (not shown) operative to generate an abort signal only if and when light intensity as sensed by the sensor drops below a preselected low threshold indicative of two or more bills having been fed in overlapped condition. Upstream of first device 80 is a currency counter 85 comprising a light source 86 and a sensor 87 associated with conventional circuitry (not shown) operative to count the number of bills fed to compartment 49*a* as the leading edge of each bill is fed past the sensor.

As best shown in FIG. 3, the apparatus further comprises a wire printer having a print head 90 that is pivoted by a motor 91 to successively print a transaction receipt (not shown) at a platen 92 and then print a transaction journal record tape 93 at a platen 94. The transaction receipt preferably is printed on a 51-column card that is advanced in a direction toward the reader as viewed in FIG. 3 at the completion of the transaction. Tape 93 is preferably of encapsulated ink-coated paper so as to obviate need for a ribbon. The tape is unreeled from a roll 95 and over platen 94 into the nip defined between another sheet feed device 80 and rubber coated idler roll 81. This latter device 80 drives tape 93 with a series of jabbing motions through an aligned opening 96 in the wall of shell 11 and into compartment 21. Secured to shell 11 adjacent opening 96 is a knife blade 97 for severing tape 93 whenever shell 11 is rotated, for when that occurs, opening 96 will be moved out of alignment with the transaction tape path.

SUMMARY OF OPERATION

Assume initially that currency 16 of differing denominations and of known quantities has been inserted in the compartments 18*a, b, c* of cartridge 10; that solenoids 32, 33, 51, 52 and 67 are deenergized; that the assembled cartridge is inserted in its prescribed location with cartridge keys 14*a, b* retained between lugs 42*a, b* (see FIGS. 2, 3); and that depending portion 19 of cover 13 has been rotated manually to uncover opening 15. Under these conditions, the various parts will be in the respective positions at which they are shown in FIGS. 2 and 3, except for roll 66 of currency feed device 63, which will be retracted from the cartridge.

As illustrated in FIG. 4, when cartridge 10 is inserted, cartridge shell 11 will be grounded by contact with support plate 34, enabling manual rotation of cover 13 to expose opening 15; and a series of mechanical switches 101*a, b, c* will be closed. With switch 101*b* closed, a bank teller can now key into a special keyboard 102 (not accessable to customers) the amount of currency of the various denominations in the respective cartridge compartments 18*a, b, c* and have this data stored in suitable storage within a controller 103. With switch 101*c* closed, the teller can now depress another key on keyboard 102 to initiate the following sequence of operations: (a) energize solenoid 33 to latch the entire cartridge 10 to turntable 27; (b) cause turntable drive control circuitry 104 to rotate the turntable until opening 15 is at the preselected offset station W (FIG. 3) for accessing cartridge escrow portion 45; (c) deenergize solenoid 33 to lock shell 11 and enable circuitry 104, through the turntable, to rotate core 12 relative to shell 11 for aligning escrow portion 45 with opening 15 at location W; and (d) energize both solenoids 32, 33 to lock cartridge 10 in this position. The teller now grasps escrow portion 45, removes it manually from the cartridge, and inserts it in retainer plate 47, as shown in phantom lines in FIG. 3. The apparatus is now ready for operation by the customer.

The customer inserts his credit card 105 in a credit card reader 106 forming part of the apparatus, and appropriate data is transmitted to controller 103. A console (not shown) of conventional type will instruct the customer on the various transaction steps to be taken. With switch 101*a* closed, the customer can now, for example, enter a personal identification number in a keyboard 107 for transmission to controller 103 and customer authentication. Next, the customer can key in on keyboard 107 the amount of currency desired; e.g., $50. This will initiate the following sequence of operations under control of controller 103: (a) energize solenoid 33, then rotate the entire cartridge 10 through turntable 27 until opening 15 aligns with currency dispensing station X; (b) deenergize solenoid 33, then rotate the turntable to rotate core 12 relative to the now stationary shell 11 until compartment 18*a* containing the $20 bills is aligned with opening 15 at station X; (c) energize solenoids 32, 33 to lock the entire cartridge in this position; (d) energize solenoid 67 to swing feed roll 66 into its operative position, then actuate stepping motor 77 to rotate this feed roll for feeding currency through throat 78 into chute 79 for advancement by devices 80, 81 into compartment 49*a*.

Since in the example illustratively assumed, the customer desires $50, controller 103 will be programmed to call for two $20 bills and two $5 bills to be dispensed. When the second $20 bill is still in the nip of roll 66 and pad 69, its leading edge will be detected by counter 85 to stop rotation of roll 66 after the second $20 bill is fed into throat 78. Controller 103 will now initiate the following sequence of operations: (a) deenergize solenoid 67 for retracting feed roll 66; (b) deenergize solenoids 32, 33; (c) through turntable 27, rotate core 12 relative to shell 11 until compartment 18*b* containing the $5 bills is aligned with opening 15 at station X; (d) reenergize solenoids 32, 33 to lock the entire cartridge in its new position; (e) reenergize solenoid 67 for restoring feed roll 66 to its operative position; and (f) operate stepping motor 77 to cause roll 66 to dispense two $5 bills.

Assuming now that the two $20 and two $5 bills have been received without problem in shuttle chamber 49*a*, solenoid 51 will be energized to lock slide 48 to the remainder of shuttle 49. Then after a preselected short time interval, a motor 110 (FIG. 4) will be operated under control of controller 103 for rotating pinion 55 to drive rack 56 to move shuttle 49 to the position D indicated in phantom lines and in which it is exposed where the customer can grasp and remove the currency.

Meanwhile the customer will receive the transaction receipt printed at platen 92 and delivered to the customer by means (not shown) not pertinent to the present invention. Also the requisite data concerning this transaction will be printed on transaction record tape 93 and the record tape will be advanced into compartment 21 of cartridge 10 by device 80, 81.

Assume now that two $5 bills are fed overlapped, indicating a misfeed condition. Detector 82 will operate to generate an abort signal, causing the controller 103 to initiate the following sequence of operations: (a) stop stepping motor 77 to cease further currency feeding; (b) operate motor 110 to cause pinion 55 to shift slide 48 laterally relative to the remainder of shell 49; (c) energize solenoid 52 to cause plunger portion 60*a* to force all currency then stored in escrow compartment 49*a* (including the misfed currency which will now have entered the compartment) into cartridge escrow portion 45; (d) deenergize solenoid 52; (e) reverse operation of motor 110 to operatively restore slide 48 to normal position; (f) wipe out the count made by counter 85; (g) resume operation of stepping motor 77 to ab initio initiate a currency dispensing cycle. No transaction receipt or record tape will be printed when the currency dispensing operation is thus aborted.

Assume now that the currency stored in cartridge 10 is substantially depleted, or that for some other reason, it is desired to remove the cartridge. The teller now keys into keyboard 102 an appropriate command that is transmitted via switch 101*c* to controller 103 to cause shell 11 and core 12 to be rotated in the manner previously described; i.e., to align opening 15 and the escrow-portion-receiving part of core 12 at station W so that escrow portion 45 can be reinserted manually, then restore cartridge 10 to the position shown in FIG. 3 (except with feed roll 66 retracted); and finally rotate cover 13 manually to close opening 15. Now, when the cartridge is withdrawn as a unit from the apparatus, it will contain all undispensed currency, including rejected currency, and also contain a journal record of each transaction, thus accounting for all currency initially stored in the cartridge.

Description and Operation FIG. 5

According to this variation of the invention, the apparatus has three dispensing stations X, Y, Z disposed 120° apart, but serviced by a single cartridge 10, preferably of larger diameter than that employed with the single station version. Since customers may be accommodated at each station, it is necessary that shell 11 be rotatable to three positions, 120° apart, to bring the dispensing opening 15 into alignment with a respective station X, Y, Z, as well as rotatable to three offset stations in which opening 15 provides access to a respective one of three removable cartridge portions 45. In other words, there preferably is a separate removable escrow portion 45 for each station X, Y, Z. Hence, as in the single station version, the cartridge upon removal from the apparatus will contain all undispensed currency including rejected currency and also contain journal records of all transactions conducted at all three stations.

It should be noted that solenoid 33 will now be operated to align opening 15 at a desired one of the three dispensing stations X, Y or Z, as well as at their respective offset stations (like W) at which escrow portions 45 are manually removable or insertable. Solenoid 32 will operate as in the earlier embodiment to control movement of the selected currency compartments into dispensing position aligned with opening 15 and then latch the compartments in such a position during the dispensing operation. The multiple station dispensing version can thus be readily implemented by appropriate modification of the programming for controller 103, operation being on a selective multiplexed basis.

The three dispensing stations, X, Y, Z can be serviced by a single print head 90 and record tape 93 by providing a separate opening 96 and knife blade 97 for each station; i.e., one opening 96 will be aligned with the tape feed path when opening 15 is at station X, another opening 96 when at Y, etc. Also a separate feed device 63, currency dispense path and shuttle 49 will be provided for each station. As shown in FIG. 5, the apparatus has at each station X, Y, Z, an instruction console 111, a slot 112 for insertion of credit card 105, and an opening 113 into which shuttle 49 is advanced to make the dispensed currency available to the customer.

While the apparatus has been illustrated as using a cartridge having a manually removable escrow cartridge portion, it will be understood that, if preferred, the cartridge may be formed without a removable escrow portion; and a special escrow bin or container may be manually inserted in the retainer plate 47, with either the single station or multiple station version.

Alternatively, if desired, the apparatus could be modified to provide for automatic (rather than manual) withdrawal of escrow portion 45 from the cartridge and insertion in retainer plate 47 during a start-up sequence, and automatic removal of the escrow portion from the plate and reinsertion into the cartridge during a shutdown sequence prior to removal of the cartridge from the apparatus.

While the invention has been particularly shown and described with reference to preferred embodiments thereof, it will be understood by those skilled in the art that various changes in form, detail and method, including but not limited to those above suggested, may be made therein without departing from the spirit, scope and teaching of the invention. Accordingly, the apparatus and method herein disclosed are to be considered merely as illustrative and the invention is to be limited only as specified in the claims.

What is claimed is:

1. For use in an apparatus for conducting financial transactions, a cartridge comprising:

two concentric members, the outer having an opening through which currency can be dispensed, and the inner providing a plurality of compartments for storing currency of differing denominations;

one of said members adapted to be rotatable relative to the other member to align a selected compartment with the opening preparatory to a currency dispensing operation;

a plurality of circumferentially spaced fixed stop elements projecting radially from a central core of said inner member; and a plurality of compacting elements disposed between said stop elements and freely rotatable about said core, said elements being flexible and frictionally engaging the inner surface of said outer member to automatically compact the currency within the respective compartments upon rotation of said inner member relative to said outer member.

2. A cartridge according to claim 1, further comprising means including at least one of said members cooperating to provide another compartment isolated from and spaced axially from the currency storing compartments, said means providing a slot to permit a journal record of the transactions to be fed into said other compartment.

3. For use in an apparatus for conducting financial transactions, a cartridge comprising:

two concentric members, the outer having an opening through which currency can be dispensed, and the inner providing a plurality of compartments for storing currency of differing denominations;

one of said members adapted to be rotatable relative to the other member to align a selected compartment with the opening preparatory to a currency dispensing operation; and a generally wedge-shaped portion removably contained in the inner member and removable therefrom when said opening is aligned with said portion, said portion having a lateral opening in one of its radial sides.

4. For use in an apparatus for conducting financial transactions, a cartridge comprising:

two concentric members, the outer having an opening through which currency can be dispensed, and the inner providing a plurality of compartments for storing currency of differing denominations;

one of said members adapted to be rotatable relative to the other member to align a selected compartment with the opening preparatory to a currency dispensing operation; and a handle and cover member having an extension normally overlying said opening and movable relative to said outer member to expose said opening, said outer member providing means for limiting rotary motion of the cover member relative to the opening.

5. A cartridge according to claim 4, wherein said cover member has a shaft-like projection rotatably received in an axial bore in said inner member.

6. Apparatus for conducting financial transactions, comprising:

means for preparing a journal record relating to each transaction;

removable cartridge means for storing currency to be dispensed and also said journal record;

means for removing currency from said cartridge means and transporting the currency along a dispensing path for delivery to a customer; and means for transporting said journal record into said cartridge means.

7. An apparatus according to claim 6, further comprising:

means for generating an abort signal to abort a transaction upon occurrence of a preselected condition; and means responsive to said signal for diverting all currency then in said path from said path to a specific portion of said cartridge means.

8. An apparatus according to claim 6, including shuttle means forming part of said currency transporting means for collecting and deferring delivery of the dispensed currency to the customer until a transaction is completed;

escrow means adjacent said shuttle means for receiving rejected currency;

means operative in response to an abort signal generated upon the occurence of a preselected condition to physically displace the currency theretofore collected in said shuttle means into said escrow means to preclude its delivery to the customer; and means operative in the absence of an abort signal and upon completion of the currency collection to move said shuttle means to a delivery position in which the collected currency is accessable to the customer.

9. An apparatus according to claim 6, wherein said cartridge means has a plurality of compartments for storing currency of differing denominations, and including means for positioning said compartments selectively at said removing means according to the denomination of the currency to be dispensed.

10. Apparatus for conducting financial transactions comprising, in combination:

cartridge means including two concentric members, the outer of which provides an opening through which currency can be dispensed, and the inner of which is rotatable and segmented into compartments for storing currency of differing denominations;

drive means for rotating one of said members relative to the other to align a selected compartment with said opening preparatory to a currency dispensing operation;

means including sheet feed means operative to engage and advance currency from the selected compartment through said opening and into a dispensing path;

means for generating an abort signal upon occurrence of a preselected condition during a transaction; and means responsive to said abort signal to divert the currency from said path upstream of exit end of said path to preclude delivery of such currency to a customer.

11. An apparatus according to claim 10, wherein said cartridge means has another compartment isolated from the currency storing compartment; and including means for printing a record of each currency issuing transaction on a journal record; and means for advancing said record into said other compartment during each successive transaction.

12. An apparatus according to claim 10, wherein said abort signal-responsive means diverts the currency from said path into an escrow container that consitutes a removable portion of the cartridge means, and said cartridge means as a whole is removable from said apparatus such that said cartridge means, upon removal from the apparatus, will contain undispensed currency, including diverted currency, and also contain a complete journal record of all transactions conducted at the apparatus with said cartridge means.

13. Apparatus for conducting financial transactions comprising, in combination:

cartridge means including two concentric members, the outer of which provides an opening through which currency can be dispensed, and the inner of which is rotatable and segmented into compartments for storing currency of differing denominations;

a plurality of currency dispensing stations in uniformly spaced disposition about the cartridge means;

drive means for controlling selective and concurrent rotation of said members, said drive means being responsive to a signal at a preselected one of the dispensing stations to cause said dispensing opening to be aligned with said preselected station, said drive means also being operative in response to a signal indicative of the currency amount requested to align appropriate currency compartments sequentially with said opening; and means including a sheet feed means associated with each station and operative to engage and advance currency from each appropriate compartment into a respective dispensing path associated with that station, whereby each station may be serviced by the single cartridge means.

14. Apparatus having a plurality of dispensing stations for conducting financial transactions comprising, in combination:

cartridge means including two concentric members, the outer of which provides an opening through which currency can be dispensed, and the inner of which is rotatable and segmented into compartments for storing currency of differing denominations;

rotatable drive means for controlling rotation of said members;

first means for operatively connecting said drive means with said outer member to enable rotation of said opening to a selectable one of the dispensing stations;

second means for operatively connecting said drive means with said inner member for enabling a selected one of the compartments to be aligned with said opening;

means responsive to signals at an operator-selected one of the stations to activate said first means and drive means; and means responsive to signals indicative of the particular currency values requested to activate said second means and drive means.

15. A method of conducting financial transactions comprising the steps of:

providing a cartridge means removably insertable in a currency dispensing apparatus, said cartridge means containing at least one compartment for storing currency of known denomination, and a different compartment for storing a journal record of each transaction conducted with that cartridge means;

moving the cartridge means to align a selected currency storing compartment at a currency dispensing station;

transporting currency from the selected compartment in quantities related to the amount of currency to be dispensed;

preparing the journal record during each transaction; and advancing the record into said different compartment during each transaction, such that upon removal from the apparatus, the cartridge means will contain the undispensed currency and also contain a journal record of all transactions conducted while the cartridge means was installed.

16. A method according to claim 15, wherein the cartridge means has a third compartment for receiving rejected currency, which third compartment is provided by a detachable portion of the cartridge means, and further characterized by the steps of:

detaching the portion upon insertion of the cartridge means in the apparatus;

storing the rejected currency in said portion while it is detached; and reinserting said portion in the cartridge means prior to removal of the cartridge means from the apparatus.

17. A method according to claim 15, including the further steps of:

providing the apparatus with a plurality of currency dispensing stations spaced circumferentially about the cartridge means; and moving the cartridge means to a selected one of the currency dispensing stations prior to the step of moving the cartridge means to align the selected first compartment with said selected currency dispensing station.

* * * * *